US005186391A

United States Patent [19]

Roueche et al.

[11] Patent Number: 5,186,391

[45] Date of Patent: Feb. 16, 1993

[54] PORTABLE SPRAYER

[76] Inventors: Wallace Roueche, 23 Delaware Avenue; Francois Robillard, 21 Beechmont Avenue, both of Ottawa, Ontario, Canada

[21] Appl. No.: 659,558

[22] Filed: Feb. 22, 1991

Related U.S. Application Data

[63] Continuation-in-part of Ser. No. 428,602, Oct. 30, 1989, abandoned.

[30] Foreign Application Priority Data

Oct. 6, 1989 [CA] Canada ..... 2000319

[51] Int. Cl.[5] ..... B05B 9/043

[52] U.S. Cl. ..... 239/373; 222/400.8

[58] Field of Search ..... 239/373, DIG. 19, 359, 239/360; 222/397, 399, 400.8, 401; 417/547, 552–554

[56] References Cited

U.S. PATENT DOCUMENTS

| | | | |
|---|---|---|---|
| 984,187 | 2/1911 | Bond | 239/373 X |
| 2,421,183 | 5/1947 | Cakebread | 222/400.8 X |
| 2,515,568 | 7/1950 | Pharo | 222/400.8 X |
| 2,901,980 | 9/1959 | Jordan | 417/554 X |
| 3,709,409 | 1/1973 | Collins | 239/373 X |
| 4,154,401 | 5/1979 | Thompson | 239/373 |
| 4,192,464 | 3/1980 | Chow | 239/373 |
| 4,248,381 | 2/1981 | Vessels | 239/DIG. 19 X |
| 4,782,982 | 11/1988 | Ellison | 239/373 X |

*Primary Examiner*—Andres Kashnikow
*Assistant Examiner*—William Grant

[57] ABSTRACT

A relatively simple pump assembly for use in a sprayer includes an elongated cylinder for mounting in a sprayer container, a plunger slidable in the cylinder, a piston on the bottom of the plunger slidably engaging the interior of the cylinder, a one-way valve in the bottom of the plunger for transferring air from above to beneath the piston during upward movement of the plunger, a second one-way valve normally closing the bottom of the cylinder for discharging air therefrom into the container to pressurize the container when the plunger and piston are reciprocated in the cylinder, a cap closing the top of the cylinder and retaining the plunger therein, a handle on the upper outer end of the plunger for movement from a latched position in which the handle can be used to carry the sprayer, and a use position in which the handle can be used to reciprocate the piston, and a sleeve on the top end of the cylinder, the sleeve having threaded bottom and top ends for (i) mounting the pump assembly in a container and (ii) mounting the cap on the cylinder, respectively.

4 Claims, 7 Drawing Sheets

PORTABLE SPRAYER

BACKGROUND OF THE INVENTION

1. Field of the Invention

This application is a continuation in part of application Ser. No. 07/428,602, filed Oct. 30, 1989, now abandoned.

The invention relates to a pump assembly for a portable sprayer.

More specifically, the invention relates to a pump assembly for pressurizing a sprayer of the type including a container for liquid to be sprayed, and a discharge assembly for discharging the liquid under the influence of air pressure in the container.

The present invention is the result of an attempt to meet the need for a portable device for decontaminating military equipment exposed to toxic chemicals or radiation. The first step in designing the device was to consider the basic principles of known pressurized sprayers. Such sprayers include a container and a pump handle for reciprocating a piston for forcing air into liquid in the container. By pressurizing the container, the liquid can be forced through a discharge tube and spray nozzle when the sprayer operator presses the trigger of a spray gun. Because the sprayer is portable, it should be as simple as possible and easy to fill, empty and clean.

2. Discussion of the Prior Art

Sprayers of the type described above are by no means new. Examples of such sprayers are described in U.S. Pat. No. 984,187, which issued to J. N. B. Bond on Feb. 14, 1911; U.S. Pat. No. 2,421,183, which issued to C. Cakebread on May 27, 1947; U.S. Pat. No. 2,515,568, which issued to G. C. Pharo on Jul. 18, 1950; U.S. Pat. No. 3,709,409, which issued to D. E. Collins on Jan. 9, 1973; U.S. Pat. No. 3,844,449, which issued to F. W. Alter on Oct. 29, 1974; U.S. Pat. No. 3,937,367, which issued to C. B. Hood on Feb. 10, 1976; U.S. Pat. No. 4,154,401, which issued to W. E. Thompson on May 15, 1979 and U.S. Pat. No. 4,192,464.

In general, those of the patented inventions which function in the same manner as the device described herein are structurally complicated and/or difficult to attach and remove from a container. If a sprayer is structurally complicated, it is difficult to clean or to keep clean. Moreover, the more complicated the sprayer, the higher the cost of producing the device.

GENERAL DESCRIPTION OF THE INVENTION

An object of the present invention is to overcome the above identified problems by providing a relatively simple pump assembly for use in a sprayer which is easy to manufacture and use.

Another object of the present invention is to provide a streamlined pump assembly, which can be quickly and easily put into use, and which contains no nooks or crannies to interfere with cleaning.

Accordingly, the present invention relates to a pump assembly for a portable sprayer of the type including a container for carrying a liquid to be sprayed, the pump assembly comprising elongated cylinder means for full insertion into the container; sleeve means at the top end of said cylinder means; first thread means on the bottom end of said sleeve means for mounting the cylinder means in the container; plunger means slidably mounted in said cylinder means; piston means on the bottom end of said plunger means; first one-way valve means in the bottom end of said plunger means for transferring air in said cylinder means from above to beneath said piston means during upward movement of said plunger means in said cylinder means; second one-way valve means normally closing the bottom end of said cylinder means for discharging the air from said cylinder means into the container means during downward movement of said plunger means; cap means closing the top end of said cylinder means for retaining said plunger means in said cylinder means; second thread means on the upper end of said sleeve means for mounting said cap means on said cylinder means handle means on the upper, outer end of said plunger means for manual reciprocation of the latter in the cylinder means; rod means extending outwardly from said sleeve means between said first and second thread means; hook means on said handle means for releasably engaging said rod means, whereby said cylinder means and plunger means can be removed as a unit from the container for filling the latter with liquid and, when said cylinder means is in the container, the hook means can be released from the rod means for reciprocation of said handle means and said plunger means in the cylinder means to pressurize the container.

The pump assembly and the sprayer described herein are intended for use with corrosive substances such as decontaminants. Accordingly the materials used in the devices are stainless steel, brass, butyl or VITON brand synthetic rubber (which is a copolymer of hexafluoropropylene and vinylidene fluoride) and TEFLON (polytetrafluoroethylene).

BRIEF DESCRIPTION OF THE DRAWINGS

The invention will be described in greater detail with reference to the accompanying drawings, which illustrate preferred embodiments of the invention, and wherein.

DESCRIPTION OF PREFERRED EMBODIMENT

Figure 1:
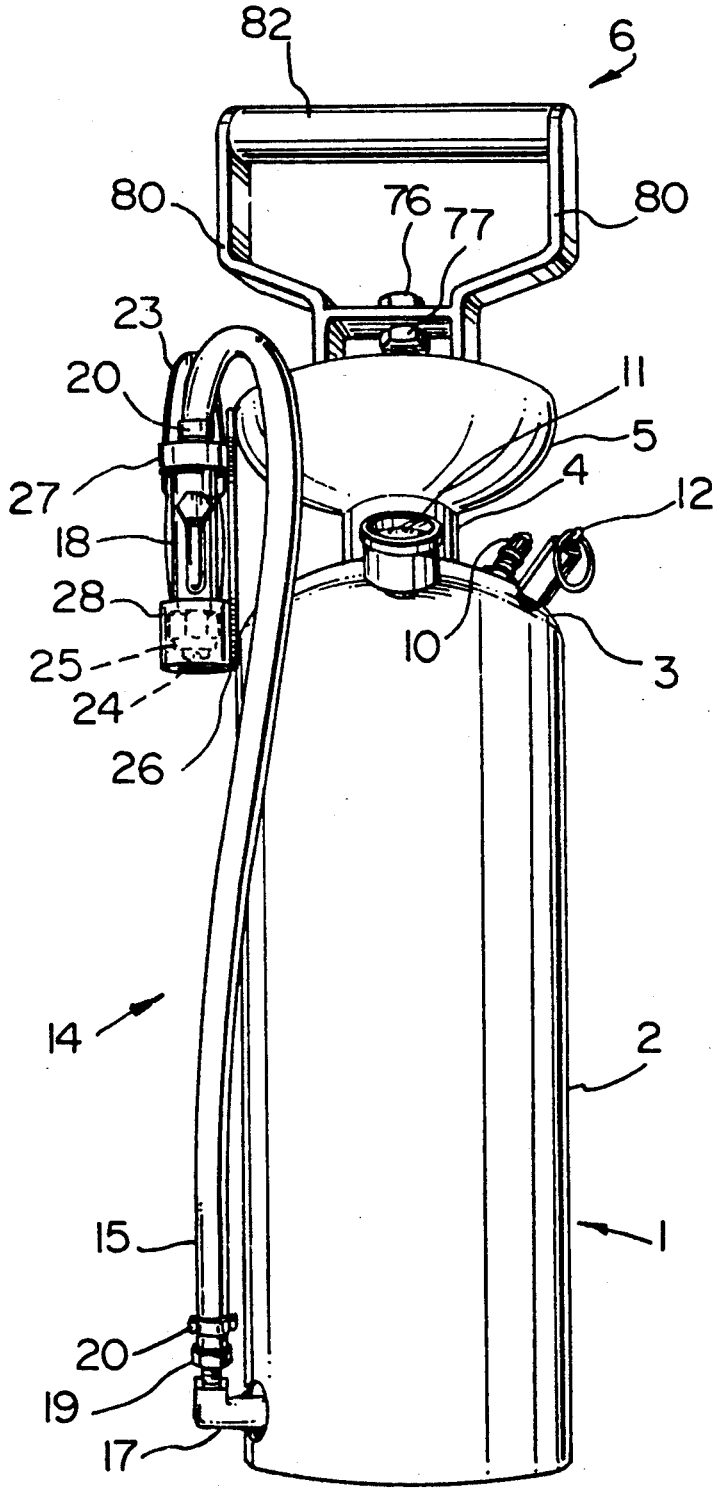
FIG. 1 is an isometric view of a first embodiment of the pump assembly of the present invention in a portable sprayer.
Figure 3:
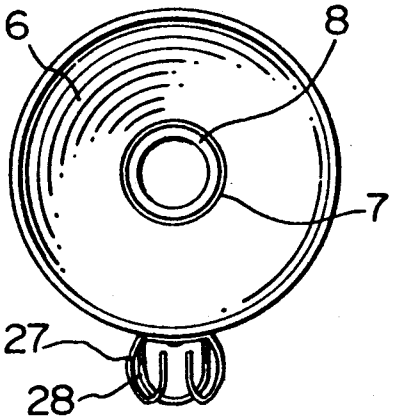
FIG. 3 is a plan view of a container used with the sprayer of FIGS. 1 and 2.
Figure 2:
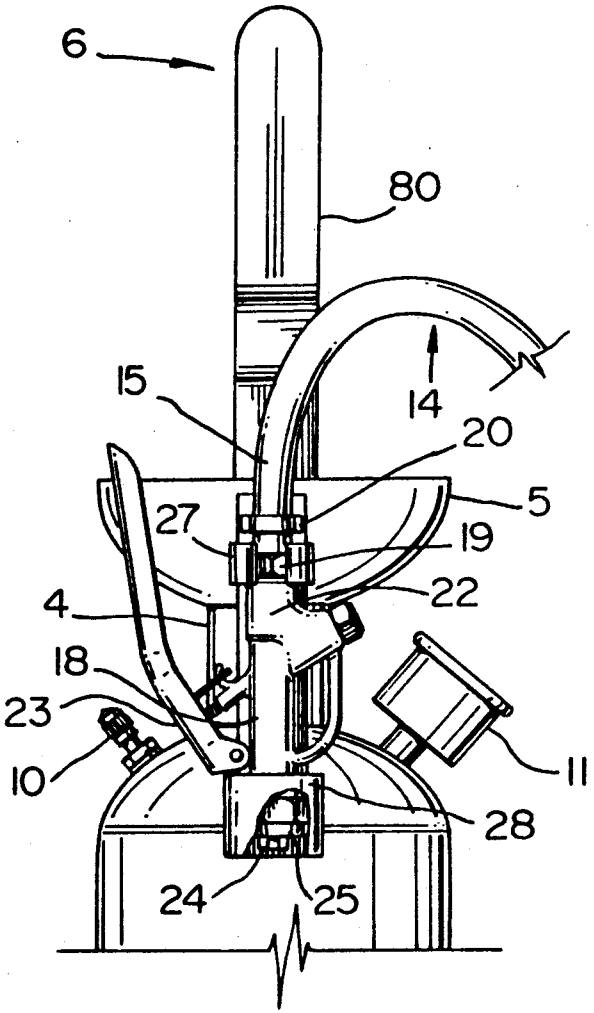
FIG. 2 is a partly sectioned, side view of the top end of the sprayer of FIG. 1.

With reference to FIGS. 1 and 2, a sprayer containing the pump assembly of the present invention includes an elongated, tubular, stainless steel container generally indicated at 1 defined by a cylindrical side wall 2 with a hemispherical top end 3, a reduced diameter, internally threaded, cylindrical neck 4 on such top end 3 and a hemispherical bowl 5 on the upper end of the neck 4. The pump assembly includes a stainless steel pump handle generally indicated at 6 extends upwardly from the centre of the bowl 5. As best shown in FIG. 3, the bowl 5 defines a hemispherical funnel extending upwardly and outwardly from the neck 4. A threaded opening 7, which receives the pump assembly (FIGS. 5 to 10) extends downwardly to a shoulder 8 in the neck 4. The upper end of the container 1 also carries other elements of the sprayer, including a brass one-way valve 10 for placing the interior of the container under pressure, a stainless steel pressure gauge 11, a brass pressure release valve 12 and the upper end of a discharge assembly generally indicated at 14.

Figure 4:
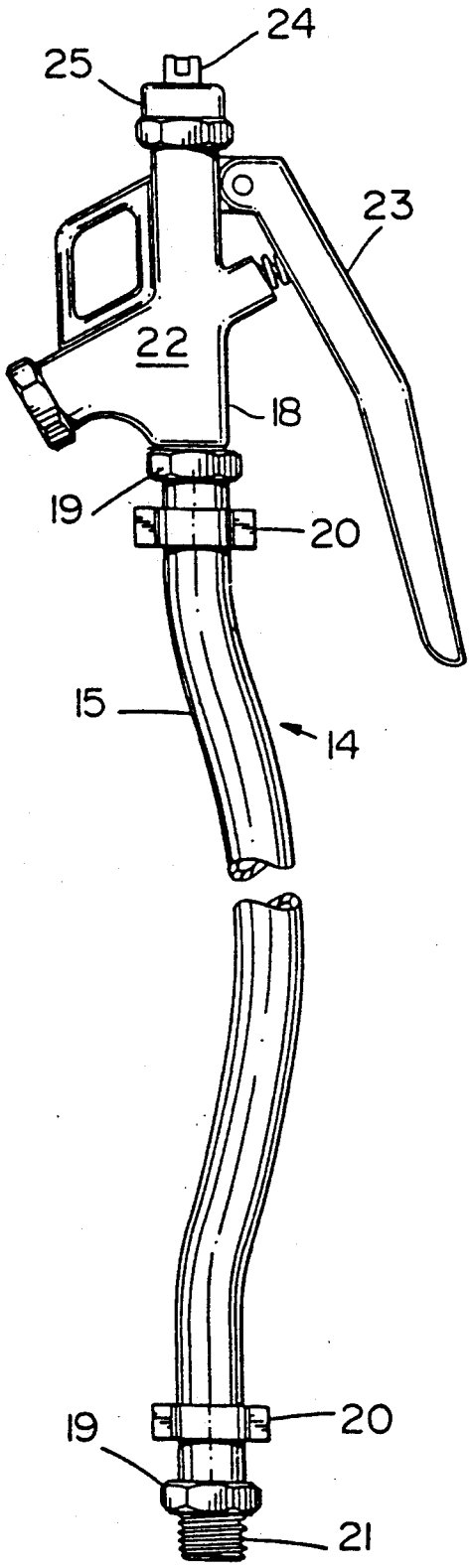
FIG. 4 is a side view of a discharge assembly used with the sprayer of FIGS. 1 and 2.
Figure 5:
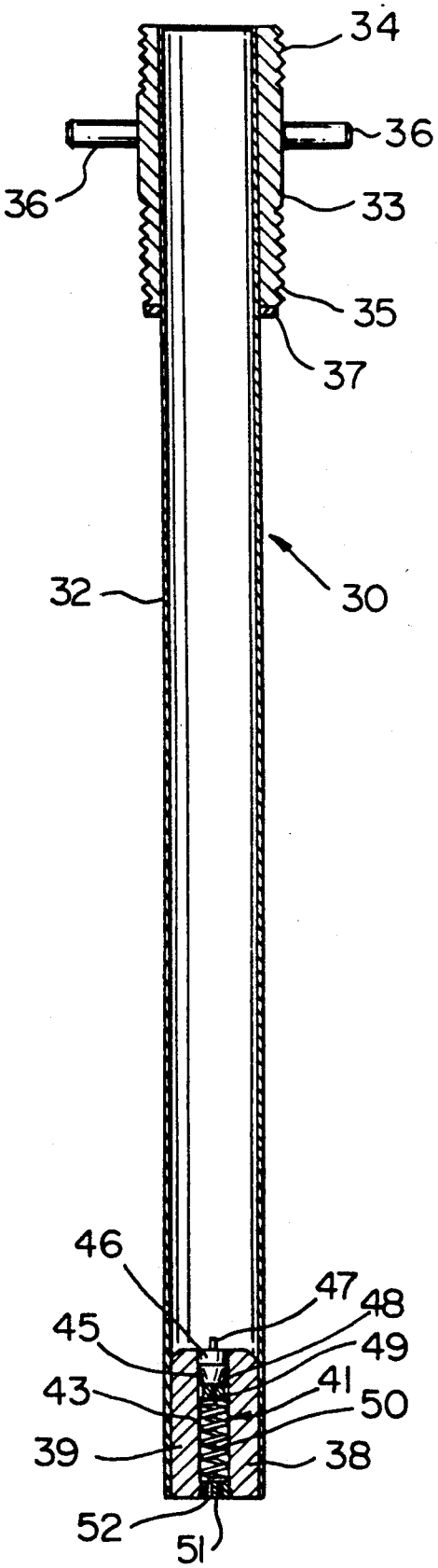
FIG. 5 is a longitudinal sectional view of a cylinder used i the pump assembly of the present invention.
Figure 6:
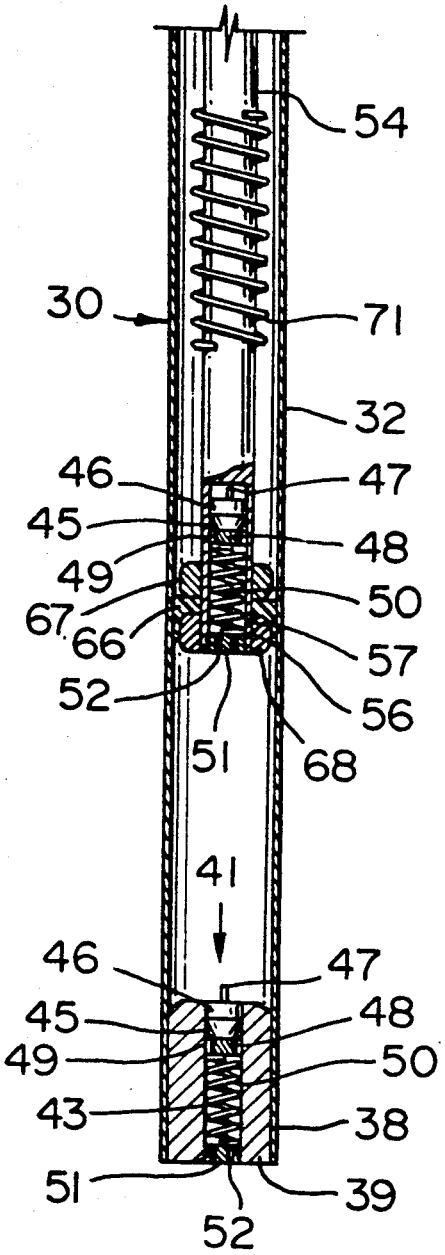
FIG. 6 is a longitudinal sectional view of the bottom ends of the cylinder of FIG. 4 and a plunger used in the pump assembly.

As best shown in FIG. 4, the discharge assembly 14 includes an elongated butyl rubber hose 15 extending upwardly from an elbow connector 17 at the lower end of the container 1. A brass spray gun 18 is attached to the free end of the hose 15. The hose 15 is connected to the connector 17 and to the gun 18 by couplers 19 and earclips 20. The coupler 19 is the type including a threaded end 21 (one shown) and a second end with annular sawtooth ridges (not shown) extending into the hose 15. An example of a suitable gun 18 is the Trigger Tee Jet Valve of Spraying Systems Co. The gun 18 includes a body 22, a spring loaded lever or trigger 23 and a brass nozzle 24 retained on the end of the body 22 by a brass retainer 25. When not in use, the gun 18 is mounted in a bracket 26 on the upper end of the container 1. The bracket 26 is a strip of material with an upper spring clip 27 and a lower loop 28.

Figure 7:
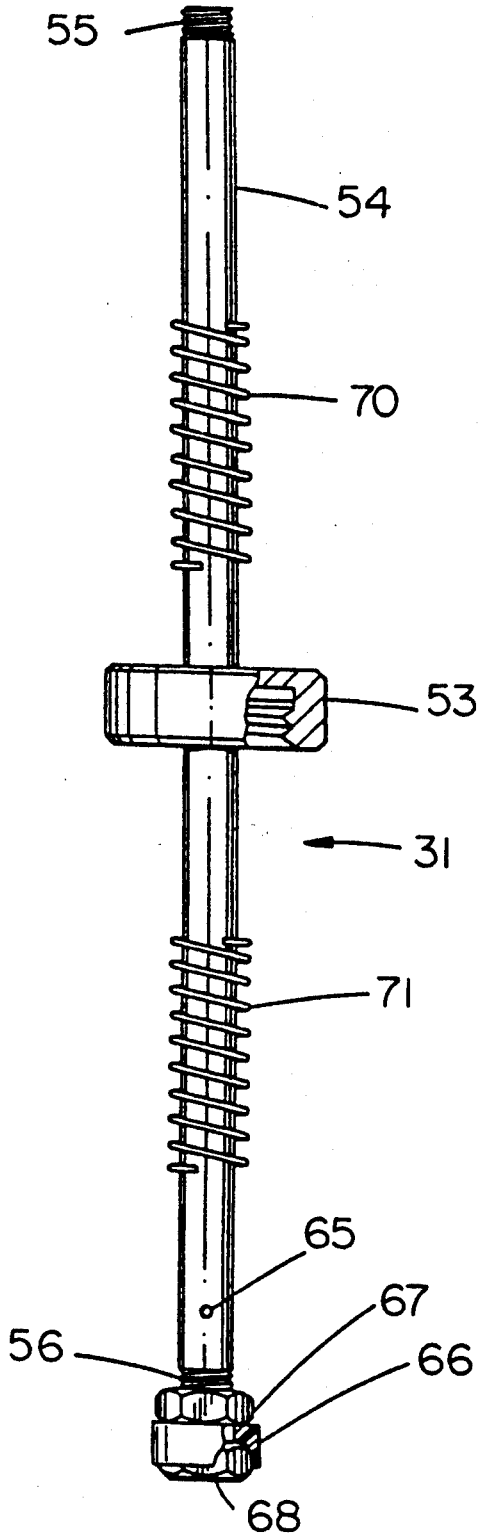
FIG. 7 is a partly sectioned side view of the plunger used in the cylinder of FIG. 6.
Figure 8:
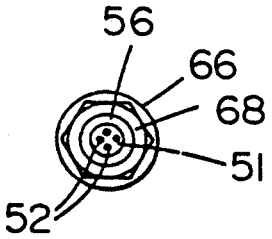
FIG. 8 is a bottom view of the plunger of FIG. 7.

Referring to FIGS. 5 to 8, the pressurizer or pump assembly mounted in the container 1 includes an elongated cylinder 30 (FIGS. 5 and 6) for slidably receiving a plunger 31 (FIGS. 7 and 8). The cylinder 30 is defined by a tubular body 32 with a sleeve 33 welded onto the upper end thereof. The sleeve 33 has externally threaded upper and lower ends 34 and 35, respectively and a pair of diametrically opposed latch bars 36 extending outwardly therefrom beneath the upper threads. An annular TEFLON seal 37 (FIGS. 5, 9 and 10) is provided at the bottom end of the sleeve 33. The seal 37 seats on the shoulder 8 (FIG. 3) at the bottom of the threaded opening 7 when the pump assembly is mounted in the container 1. The bottom end 38 of the cylinder 30 is closed by a plug 39. A one-way valve 41 is mounted in a threaded, longitudinally extending passage 43 in the plug 39. The valve 41 includes an annular seat 45 with a triangular cross section on the interior of the cylinder and a body 46 with an air inlet tube 47 in the top end thereof. A disc 48 with grooves 49 in the periphery thereof is biased against the bottom of the valve seat 45 by a helical spring 50, so that the air passages defined by the grooves 49 are normally closed by the seat 45. The spring 50 is retained in the passage 43 by a threaded disc 51, which also includes openings 52.

The top of the cylinder 30 is closed by an internally threaded brass cap 53 mounted on the upper end of the sleeve 33. The whole assembly is removably mounted in the top end of the container 1 by threading the bottom end of the sleeve 33 into the threaded opening 7 so that the seal 37 engages the shoulder 8.

The plunger 31 is defined by an elongated brass rod 54 with threaded top and bottom ends 55 and 56, respectively. The bottom end 56 of the plunger 31 includes a recess 57 (FIG. 6) for receiving a one-way valve similar to the valve in the plug 37.

The plunger 31 is slidably mounted in the cylinder 30, a piston 66 being provided between the two elements. The piston 66 is defined by a TEFLON disc-shaped body with a downwardly extending skirt. The piston 66 is mounted on the threaded bottom end 56 of the plunger 31 between a pair of brass nuts 67 and 68. By changing the distance between the nuts 67 and 68, the pressure on the piston 66 and consequently the diameter thereof can be changed to ensure a tight seal between the piston and the interior of the cylinder 30. Helical springs 70 and 71 are mounted on the rod 54 above and below the cap 53 for absorbing the forces of impact during reciprocation of the plunger.

As mentioned above, the cylinder 30 is mounted in the container 1. Because the cylinder 30 carries the plunger 31 and the piston 66, the entire assembly extends into the container.

Figure 9:
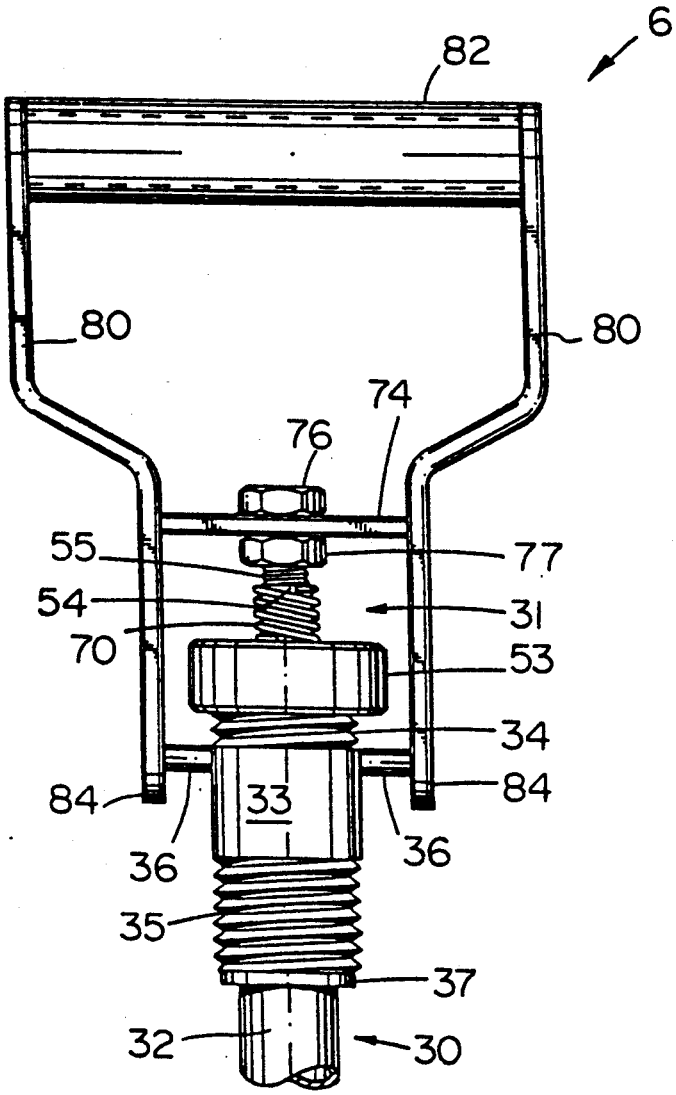
FIG. 9 is a front view of a pump handle used in the sprayer of FIG. 1.
Figure 10:
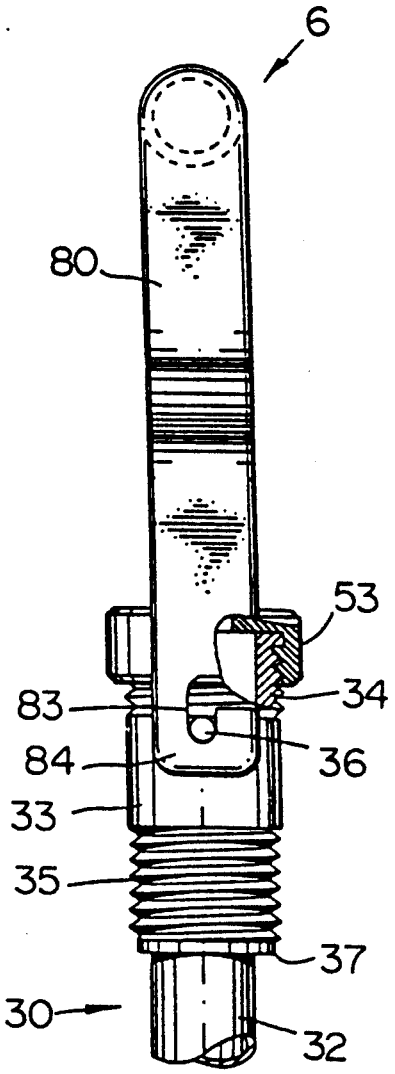
FIG. 10 is a side view of the pump handle of FIG. 9.

As best shown in FIGS. 9 and 10, the threaded upper end 55 of the plunger 31 is connected to a crossbar 74 of the handle 6 by a pair of nuts 76 and 77. The handle 6 includes a pair of sides 80 interconnected by a cylindrical grip 82 and the crossbar 74. Generally L-shaped slots 83 defining hooks are provided in the bottom ends 84 of the sides 80. The slots 83 receive the rods 36 to releasably latch the plunger 31 in the non-use or transport position. In the latched position, the spring 70 biases the handle upwardly to retain the handle in such position.

Figure 11:
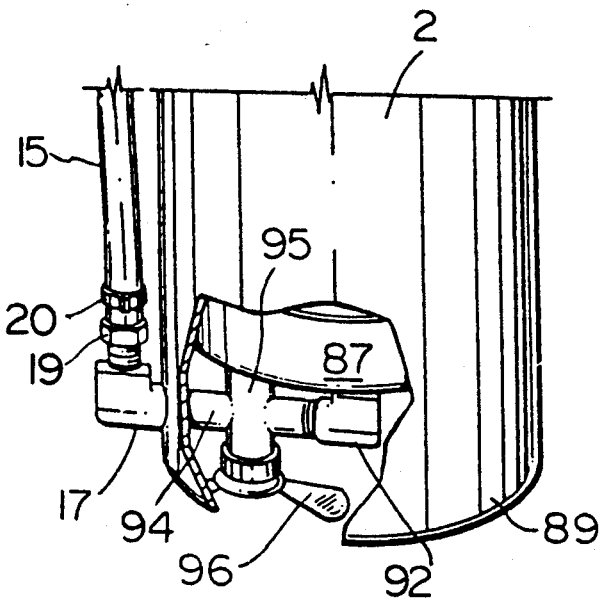
FIG. 11 is a partly sectioned, isometric view of the bottom end of the container used in the sprayer of FIG. 1.
Figure 12:
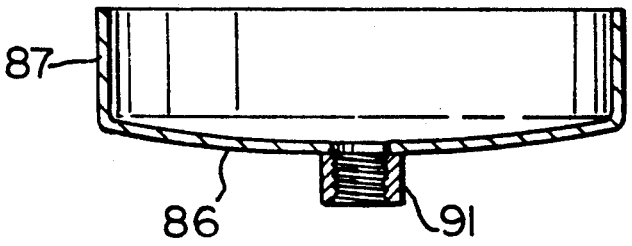
FIG. 12 is a cross section of the bottom end of the container of FIG. 11.

With reference to FIGS. 11 and 12, a bottom wall 86 with an upwardly extending skirt 87 is mounted in the lower end 89 of the container side wall 2. An internally threaded outlet 91 extends downwardly from the center of the bottom wall 86 for coupling with an elbow connector 92 and an outlet pipe 94, which extends through the side wall 2 to the connector 17. A valve 95 operated by a handle 96 is provided in the pipe 94.

In order to fill the container 1, the handle 6 (in the latched position) is grasped and rotated to release the entire pump assembly, which is removed from the container. Liquid is poured into the opening 7 to fill the container 1. The pump assembly is replaced, and the sprayer can be placed under pressure.

The sprayer can be placed under pressure by either of two methods. With the handle 6 in the latched position (FIGS. 9 and 10), downward pressure is applied to the handle grip 82 to compress the spring 70, and the handle is rotated to release the handle and the plunger 31. The plunger 31 is then reciprocated vertically in the cylinder 30. During upward movement of the plunger 31, a partial vacuum is created in the space between the piston 66 and the plug 39. Air is drawn through the opening 65 into the plunger, and passes through the one-way valve in the plunger 31 into such space. In this connection, it should be noted that there is sufficient clearance between the plunger 31 and the central opening in the cap 53 that air flows into the top end of the cylinder 30 above the piston 66. During downward movement of the plunger 31, the plunger valve closes and the cylinder valve 41 opens, so that air is forced into the container 1 to pressurize the latter. The same effect can be achieved by attaching the valve 10 to a compressed air tank (not shown).

Once the container is under pressure the handle 6 is returned to the latched position. By opening the valve 95, liquid is forced through the pipe 94 into the hose 15.

The trigger 23 is depressed to discharge liquid through the nozzle 24.

Figure 13:
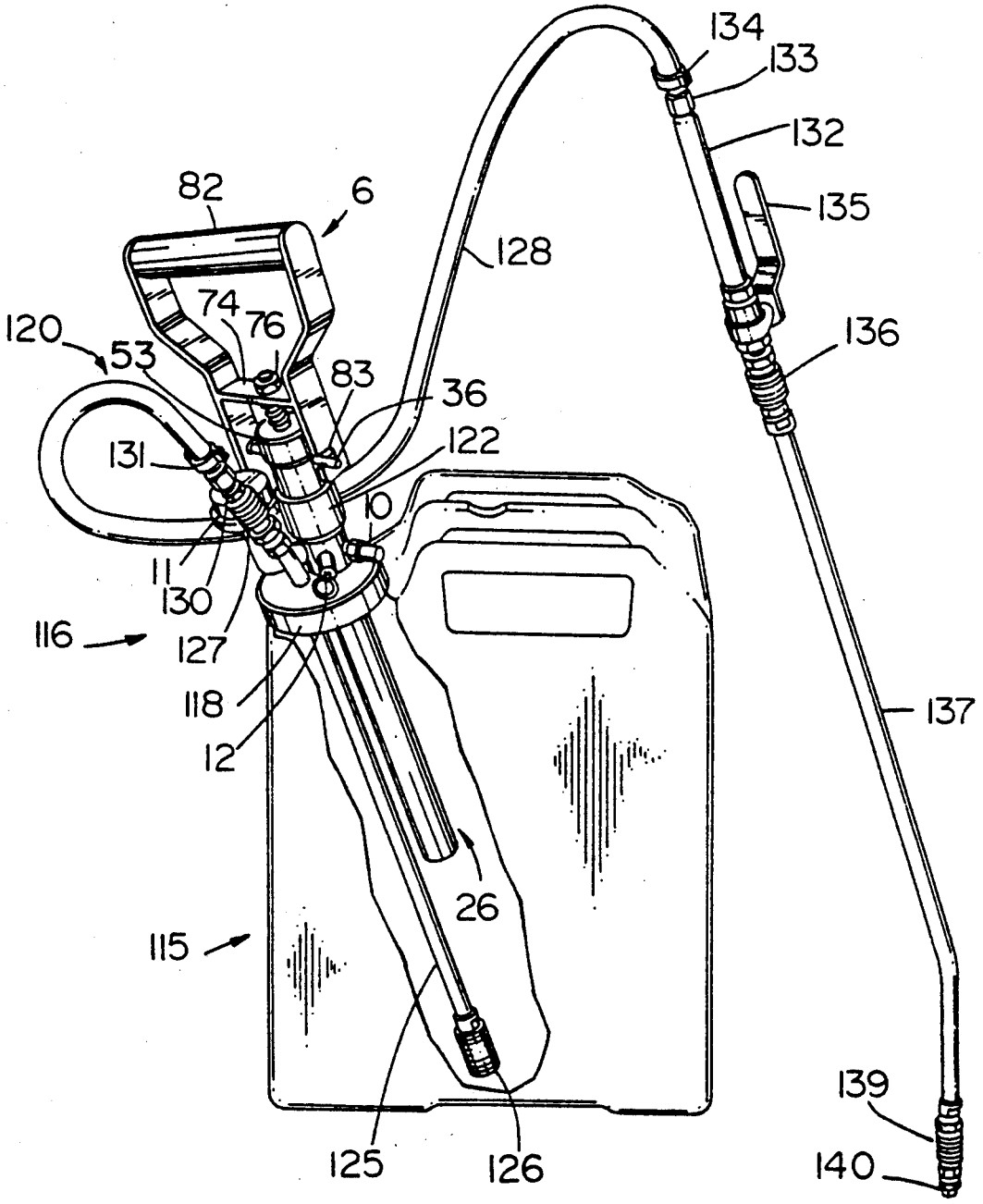
FIG. 13 is a partly sectioned, isometric view of a second embodiment of the pump assembly of the present invention in a different container.

Referring to FIG. 13, a second embodiment of the invention for use in a standard twenty liter polyethylene container generally indicated at 115 includes a head assembly generally indicated at 116. The head assembly is defined by an internally threaded cap 118 for mounting on the externally threaded neck (not shown) of the container 115. The cap 118 carries a one-way valve 10, a pressure gauge 11, a pressure relief valve 12 and a discharge assembly 120. A pressurizer or pump assembly, including the cylinder 30 and the other elements of FIGS. 5 to 8 extends through the cap 118. For such purpose, a neck 122 with a large diameter, internally threaded top end extends upwardly form the cap 118 for receiving the pump assembly. The threads 35 on the sleeve 33 (FIGS. 9 and 10) engage the threads in the neck 122. The neck 122 carries the one-way valve 10, the pressure gauge 11 and the pressure release valve 12. As in the first embodiment, a handle 6 is mounted on the threaded sleeve 33, on the upper, end of the cylinder 30. The handle 6 is the same as the handle of FIGS. 9 and 10, and accordingly will not be described in detail. A stainless steel liquid pick-up tube 125 also extends downwardly from the cap 118, so that when the latter is mounted on the neck of the container 115, the tube 125 extends downwardly to a position proximate the bottom of the container. A stainless steel strainer 126 is provided on the bottom end of the tube 125.

The outer top end of the tube 125 is connected to the hose assembly 120 by a quick release coupler 127. The hose assembly 120 is defined by a VITON rubber hose 128 joined to the coupler 127 by a connector 130 and a crimped ear clip 131. A spray gun 132, for example the RBV-25 of Royal Fluid Power, is mounted on the outer end of the hose 128 using a connector 133 and an ear clip 134. The gun 132 includes a ball valve (not shown) operated by a lever 135. Another quick release coupling 136 is used to connect an elongated wand 137 to the gun 132 and a third coupling 139 connects a spray nozzle 140 to the wand 137. Additional extensions can be provided between the gun 132 and the nozzle 140. Alternatively, the nozzle 140 can be connected directly to the gun 132 using the quick release coupling 136.

We claim:

1. A pump assembly for a portable sprayer including a container for carrying a liquid to be sprayed, the pump assembly comprising elongated cylinder means for full insertion into the container; sleeve means at the top end of said cylinder means; first thread means on the bottom end of said sleeve means for mounting the cylinder means in the container; plunger means slidably mounted in said cylinder means; piston means on the bottom end of said plunger means; first one-way valve means in the bottom end of said plunger means for transferring air in said cylinder means from above to beneath said piston means during upward movement of said plunger means in said cylinder means; second one-way valve means normally closing the bottom end of said cylinder means for discharging the air from said cylinder means into the container during downward movement of said plunger means; cap means closing the top end of said cylinder means for retaining said plunger means in said cylinder means; second thread means on the upper end of said sleeve means for mounting said cap means on said cylinder means; handle means on the upper, outer end of said plunger means for manual reciprocation of the latter in the cylinder means; rod means extending outwardly form said sleeve means between said first and second thread means; hook means on said handle means for releasably engaging said rod means, whereby said cylinder means and plunger means can be removed as a unit from the container for filling the latter with liquid and, when said cylinder means is in the container, the hook means can be released from the rod means for reciprocation of said handle means and said plunger means in the cylinder means to pressurize the container.

2. A pump assembly according to claim 1, wherein said handle means includes a pair of parallel, spaced apart sides; first crossbar mans extending between said sides for receiving the top, outer end of said plunger means; second crossbar means extending between the upper ends of said sides for manual operation of the plunger means; and slot means in the lower ends of said sides defining said hook means.

3. A pump assembly according to claim 2, including first spring means on said plunger means between said cap means and said piston means for cushioning the sprayer during reciprocation of the plunger means in the container.

4. A pump assembly according to claim 1, including cover means beneath said rod means for mounting the pump assembly on the container, said cover means including third thread means for mounting the cover means on the container; upwardly extending tubular neck means for receiving said cylinder means; and fourth thread means in said neck means for connecting the cover means to said first thread means on the cylinder means.

* * * * *